US011183354B2

(12) United States Patent
Liu et al.

(10) Patent No.: US 11,183,354 B2
(45) Date of Patent: Nov. 23, 2021

(54) DRAWER-TYPE CARRYING DEVICE FOR ACCELERATOR AND CABIN STRUCTURE FOR ACCELERATOR

(71) Applicant: Nuctech Company Limited, Beijing (CN)

(72) Inventors: Yaohong Liu, Beijing (CN); Liang Zhang, Beijing (CN); Xiaotong Zhang, Beijing (CN)

(73) Assignee: NUCTECH COMPANY LIMITED, Beijing (CN)

( * ) Notice: Subject to any disclaimer, the term of this patent is extended or adjusted under 35 U.S.C. 154(b) by 389 days.

(21) Appl. No.: 16/231,667

(22) Filed: Dec. 24, 2018

(65) Prior Publication Data

US 2019/0198282 A1 Jun. 27, 2019

(30) Foreign Application Priority Data

Dec. 26, 2017 (CN) ..... 201711432279.0

(51) Int. Cl.
*H01H 5/00* (2006.01)
*H01J 33/02* (2006.01)
(Continued)

(52) U.S. Cl.
CPC ..... *H01J 33/02* (2013.01); *H05H 5/03* (2013.01); *H05H 7/22* (2013.01); *H01J 2229/8626* (2013.01)

(58) Field of Classification Search
CPC ..... A61N 2005/1076; A61N 5/1048; A61N 5/1075; A61N 5/1042
See application file for complete search history.

(56) References Cited

U.S. PATENT DOCUMENTS 5,326,970 A 7/1994 Bayless
5,401,973 A 3/1995 McKeown et al.
(Continued)

FOREIGN PATENT DOCUMENTS

CA 2 932 676 A1 6/2015
CN 101349660 A 1/2009
(Continued)

OTHER PUBLICATIONS

EPO tranlation of CN104717821, translated on 03/37/2020.*
Canadian Examination Search Report dated Jun. 14, 2019 received in Canadian Application No. 3,028,509.
(Continued)

*Primary Examiner* — Dani Fox
(74) *Attorney, Agent, or Firm* — Scully Scott Murphy & Presser

(57) ABSTRACT

The present disclosure provides a drawer-type carrying device for an accelerator and an cabin structure for the accelerator, the drawer-type carrying device for the accelerator includes a frame mechanism and a drawing mechanism. The frame mechanism is used for installing the accelerator; the drawing mechanism is connected with the frame mechanism and the frame mechanism is movable relative to the drawing mechanism. The cabin structure for the accelerator includes a cabin, a shielding mechanism and a drawer-type carrying device for the accelerator. The cabin has a working area and a maintenance area. The shielding mechanism is disposed in the working area and has a side opening door facing towards the maintenance area. The frame mechanism is capable of drawn from the shielding mechanism into the maintenance area when the side opening door is opened.

13 Claims, 6 Drawing Sheets

(51) Int. Cl.
*H05H 5/03* (2006.01)
*H05H 7/22* (2006.01)

(56) References Cited

U.S. PATENT DOCUMENTS

| | | | |
|---|---|---|---|
| 5,428,658 | A | 6/1995 | Oettinger et al. |
| 6,002,734 | A | 12/1999 | Steinman |
| 8,455,820 | B2 | 6/2013 | Agemura et al. |
| 8,541,756 | B1 | 9/2013 | Treas |
| 9,123,519 | B2 | 9/2015 | Bendahan et al. |
| 2005/0117683 | A1 | 6/2005 | Mishin et al. |
| 2010/0310045 | A1 | 12/2010 | Brown et al. |
| 2014/0270086 | A1 | 9/2014 | Krasnykh |
| 2016/0345418 | A1 | 11/2016 | Whittum et al. |

FOREIGN PATENT DOCUMENTS

| | | | |
|---|---|---|---|
| CN | 101788508 | A | 7/2010 |
| CN | 103226111 | A | 7/2013 |
| CN | 104717821 | A | 6/2015 |
| CN | 104865283 | A | 8/2015 |
| CN | 105879246 | A | 8/2016 |
| CN | 106132060 | A | 11/2016 |
| CN | 106879156 | A | 6/2017 |
| CN | 107884425 | A | 4/2018 |
| CN | 107979911 | A | 5/2018 |
| CN | 207911115 | U | 9/2018 |
| JP | 2009162577 | A | 7/2009 |
| JP | 2010243369 | A | 10/2010 |
| WO | 2012005629 | A1 | 1/2012 |

OTHER PUBLICATIONS

Demsky M. et al., "Facility for Gamma Activation Analysis With 8 meV, 10 kW Linear Accelerator", Low Energy Electron Beams for Industrial and Environmental Applications EuCARD-2 Workshop with Industry, Warsaw, Poland (Dec. 8-9, 2016) (cited in Australian Examination Report).

Randa Z. et al., "Fast Determination of Gold in Large Mass Samples of Gold Ores by Photoexcitation Reactions Using 10 MeV Bremsstrahlung", Journal of Radioanalytical and Nuclear Chemistry 271(3):603-606 (2007) (cited in Australian and Canadian Examination Reports).

Tickner J. et al., "Measurement of Gold and Other Metals in Electronic and Automotive Waste Using Gama Activation Analysis", J. Sustain. Metall. 2:296-303 (2016) (cited in Australian and Canadian Examination Reports).

Australian Examination Report dated Jul. 7, 2020 received in Canadian Application No. 3,028,509.

Canadian Examination Report dated Jun. 23, 2020 received in Australian Application No. 2018286570.

U.S. non-Final Office Action dated Apr. 22, 2020 received in related U.S. Appl. No. 16/231,672.

Office Action dated Apr. 1, 2021 received in Canadian Patent Application No. CA 3,028,509.

Kutsaev, S. et al., "Electron Linac with Deep Energy Control for Adaptive Rail Cargo Inspection System", 2015 IEEE Nuclear Science Symposium and Medical Imaging Conference, Oct. 31, 2015, pp. 1-7.

Extended European Search Report dated Aug. 10, 2021 received in European Patent Application No. EP 18894631.3.

* cited by examiner

DRAWER-TYPE CARRYING DEVICE FOR ACCELERATOR AND CABIN STRUCTURE FOR ACCELERATOR

CROSS-REFERENCE TO RELATED APPLICATIONS

The present application is based on and claims priority to Chinese Application No. 201711432279.0, filed on Dec. 26, 2017, entire contents of which is hereby incorporated by reference.

TECHNICAL FIELD

The present disclosure relates to an accelerator, in particular to the field such as mineral analysis and irradiation in which an accelerator is used as a radiation source.

BACKGROUND

With the continuous improvement of electron accelerator technology, more and more industries use high-power accelerators for various applications. For example, high-energy electrons accelerated by accelerators are used to modify products, and foods are irradiated and sterilized in the food industry. X-rays are commonly used in agriculture for irradiation breeding, stimulating yield, radiation pest control, and for sterilization of instruments in the medical industry and substance identification in the mineral industry.

At present, the high-power acceleration tube has a larger length which is generally more than 1 m. When the acceleration tube is installed and adjusted, it needs to be removed from the accelerator cabin as a whole, thereby resulting in inconvenient operation and low efficiency. Moreover, it is also necessary to reserve a larger space volume outside the accelerator cabin for storing the acceleration tube, thereby causing waste of the application site.

SUMMARY

A main objective of the present disclosure is to overcome at least one of the above-mentioned drawbacks of the prior art, and to provide a drawer-type carrying device for an accelerator and an cabin structure for the accelerator, so as to facilitate installation and adjustment of the accelerator, thereby saving operation time and improving space utilization.

In order to achieve the above objective, the present disclosure provides a drawer-type carrying device for an accelerator and an cabin structure for the accelerator, the drawer-type carrying device for the accelerator includes a frame mechanism and a drawing mechanism. The frame mechanism is used for installing the accelerator; the drawing mechanism is connected with the frame mechanism and the frame mechanism is movable relative to the drawing mechanism.

The present disclosure also provides a cabin structure for the accelerator including a cabin body, a shielding mechanism and a drawer-type carrying device for the accelerator. The drawer-type carrying device for the accelerator includes a frame mechanism and a drawing mechanism. The frame mechanism is used for installing the accelerator; the drawing mechanism is connected with the frame mechanism and the frame mechanism is movable relative to the drawing mechanism. The cabin body has a working area and a maintenance area. The shielding mechanism is disposed in the working area and has a side opening door facing towards the maintenance area. The frame mechanism is capable of drawn from the shielding mechanism into the maintenance area when the side opening door is opened.

Compared with the prior art, the present disclosure has the advantages in that: the accelerator moves the accelerator in a drawing manner, which greatly reduces the operation difficulty and improves maintenance and adjustment efficiency of the high-power accelerator. Moreover, by utilizing the drawer-type carrying device of the present disclosure, adjustment or maintenance can be accomplished inside the cabin structure for the accelerator. Therefore, it is not necessary to reserve a space volume outside the accelerator cabin, thereby improving utilization of the internal space of the cabin and avoiding waste of the outer space of the cabin.

BRIEF DESCRIPTION OF THE DRAWINGS

The various objects, features and advantages of the present disclosure will become more apparent from the detailed description of the preferred embodiments of the present disclosure with reference to the accompanying drawings. The drawings are only illustrative of the present disclosure and are not necessarily to scale. In the drawings, like reference numbers generally refer to the same or similar components. In the drawings.

DETAILED DESCRIPTION

Figure 1:
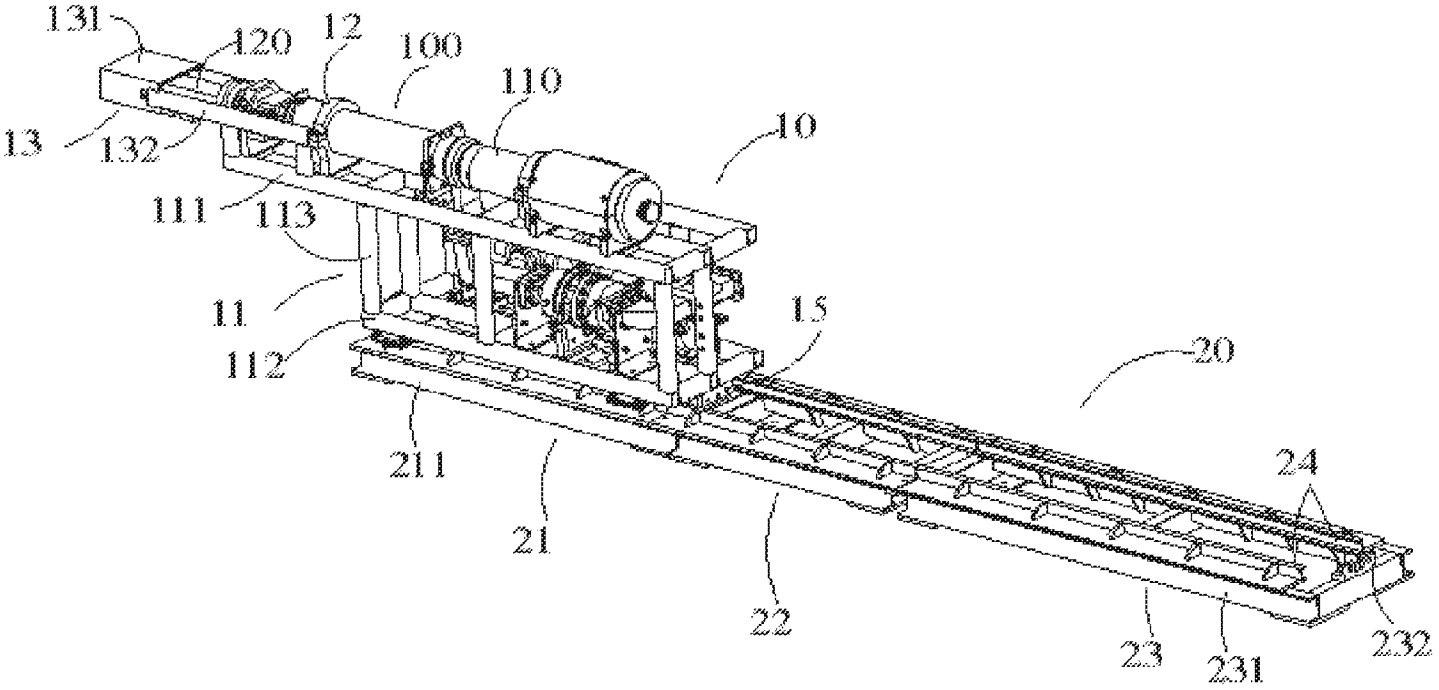
FIG. 1 is a perspective view of a drawer-type carrying device for an accelerator of the present disclosure.

Example embodiments will now be described more fully with reference to the accompanying drawings. However, the example embodiments can be embodied in a variety of forms, and should not be construed as being limited to the embodiments set forth herein; rather, these embodiments are provided so that this disclosure will be thorough and complete, and the concepts of the example embodiments will be fully given to those skilled in the art. The same reference numerals in the drawings denote the same or similar structures, and thus their detailed descriptions will be omitted.

Although relative terms such as "lower" or "bottom" and "higher" or "top" may be used in the embodiments to describe the relative relationship of one component to another component. It should be understood that if the device is turned upside down, a component described at the "lower" side will become a component at the "higher" side. In addition, when a layer is "on" another layer or substrate, it may possible that the layer is "directly" on the other layer or substrate, or that the layer is on the other layer or substrate, or a further layer is sandwiched between other layers or substrates.

The present disclosure provides a drawer-type carrying device for an accelerator, as shown in FIGS. 1 to 4, which includes a frame mechanism 10 and a drawing mechanism 20. The frame mechanism 10 is used to install the accelerator 100. The drawing mechanism 20 is connected with the frame mechanism 10 and the frame mechanism 10 is movable relative to the drawing mechanism 20.

Figure 5:
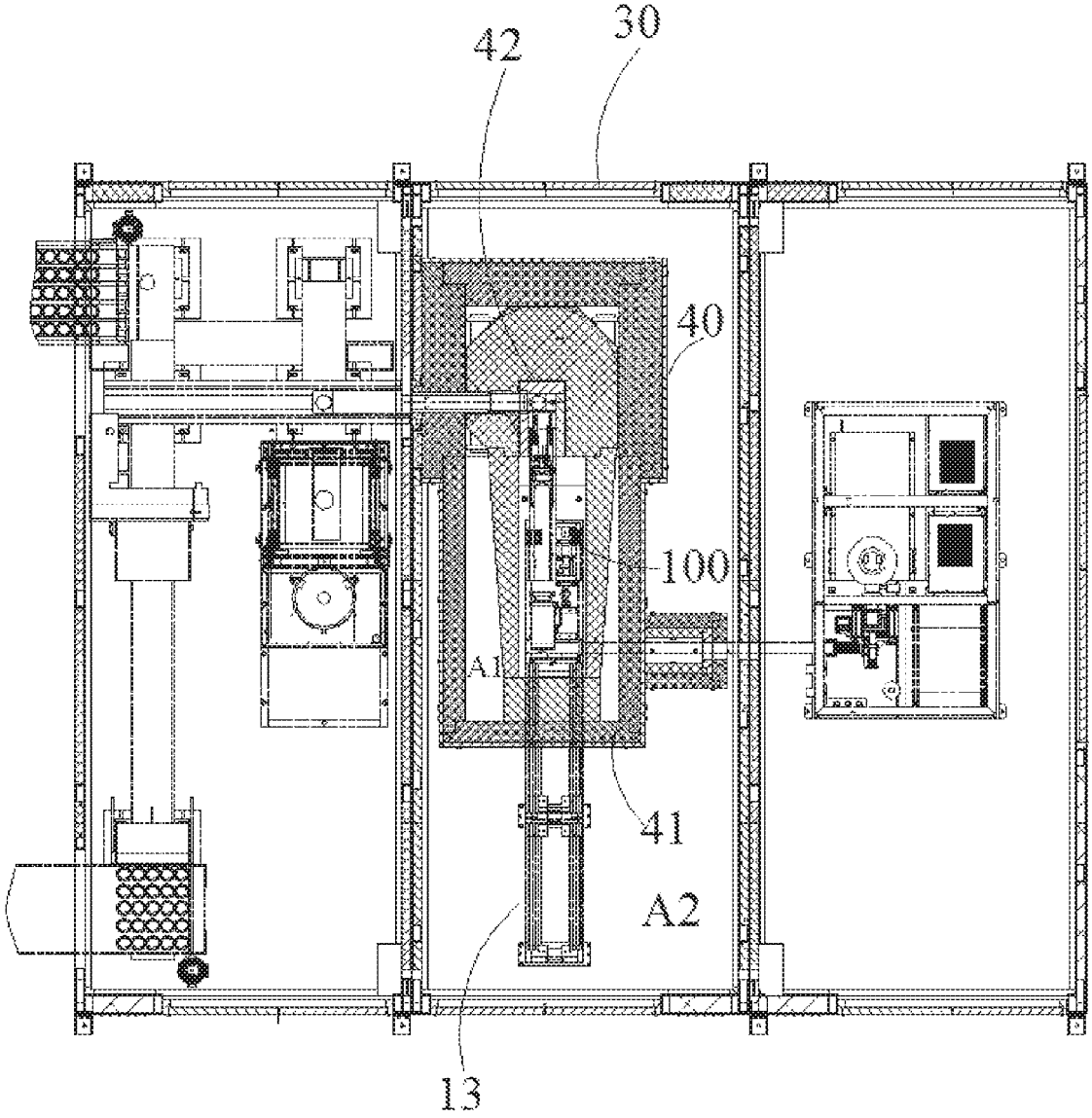
FIG. 5 is a top view of a cabin structure for an accelerator of the present disclosure.
Figure 6:
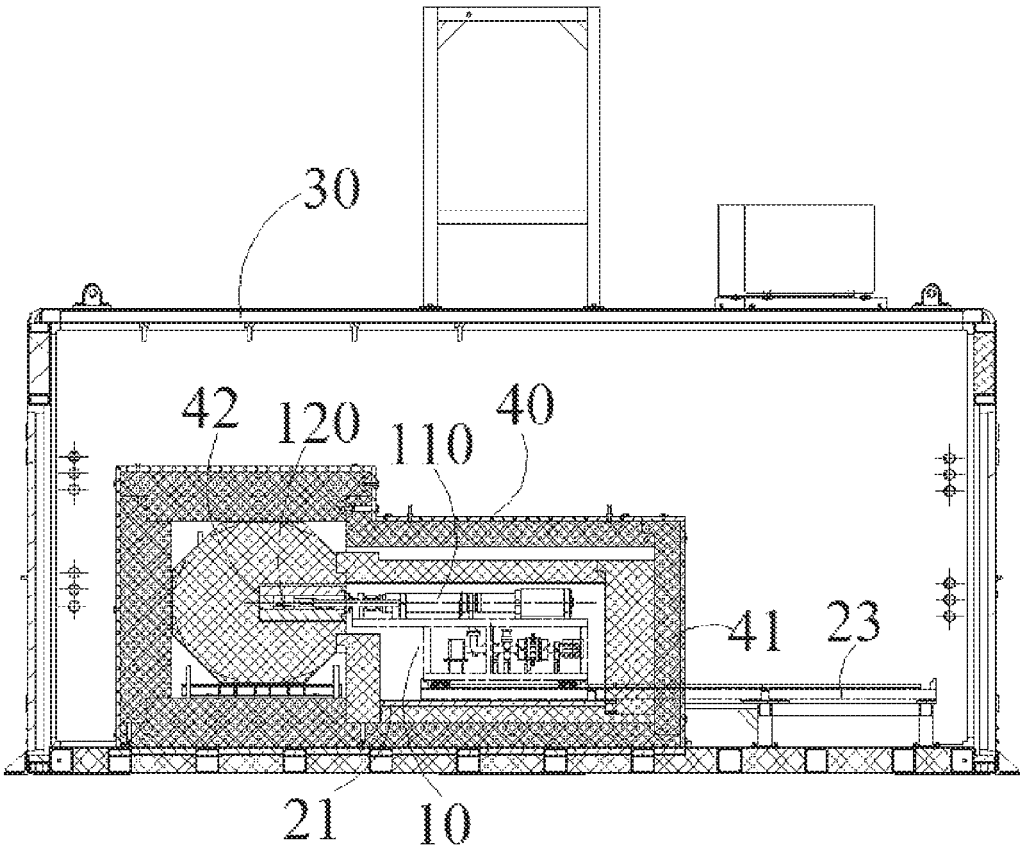
FIG. 6 is a cross-sectional view of the cabin structure for the accelerator of the present disclosure.

The drawer-type carrying device of the present disclosure may be applied to a cabin structure for an accelerator. As shown in FIGS. 5 and 6, the cabin structure for the accelerator may include a cabin 30, a shielding mechanism 40, and the above-mentioned drawer-type carrying device for the accelerator. The cabin 30 has a working area A1 and a maintenance area A2. The shielding mechanism 40 is disposed in the working area A1 and the shielding mechanism 40 has a side opening door 41 facing towards the maintenance area A2. The frame mechanism 10 is capable of drawn from the shielding mechanism 40 into the maintenance area A2 when the side opening door 41 is opened.

Therefore, when the accelerator 100 needs to be adjusted or maintained, the frame mechanism 10 carrying the accelerator 100 may be drawn, so that the accelerator 100 located in the working area A1 is moved relative to the drawing mechanism 20 to the maintenance area A2, and adjustment and maintenance may be accomplished in the cabin 30.

Therefore, compared with the prior art, the present disclosure moves the accelerator 100 in a drawing manner, which greatly reduces the operation difficulty and improving maintenance and adjustment efficiency of the high-power accelerator 100. Moreover, by utilizing the drawer-type carrying device of the present disclosure, adjustment or maintenance can be accomplished inside the cabin structure for the accelerator. Therefore, it is not necessary to reserve a space volume outside the accelerator 100 cabin 30, thereby improving utilization of the internal space of the cabin 30 and avoiding waste of the outer space of the cabin 30.

Figure 2:
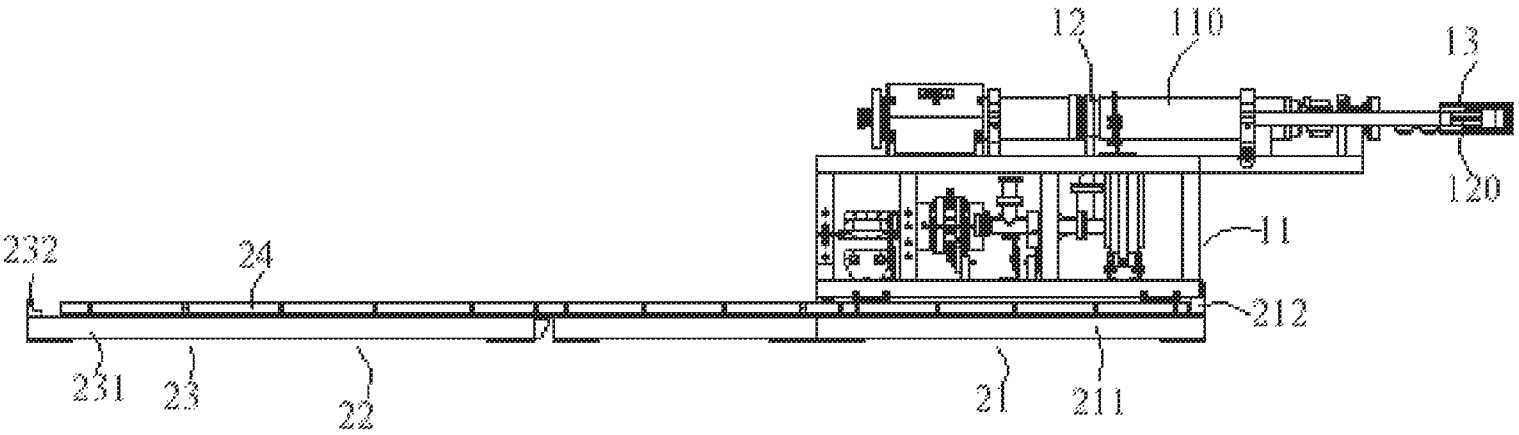
FIG. 2 is a front view of a drawer-type carrying device for an accelerator of the present disclosure.
Figure 3:
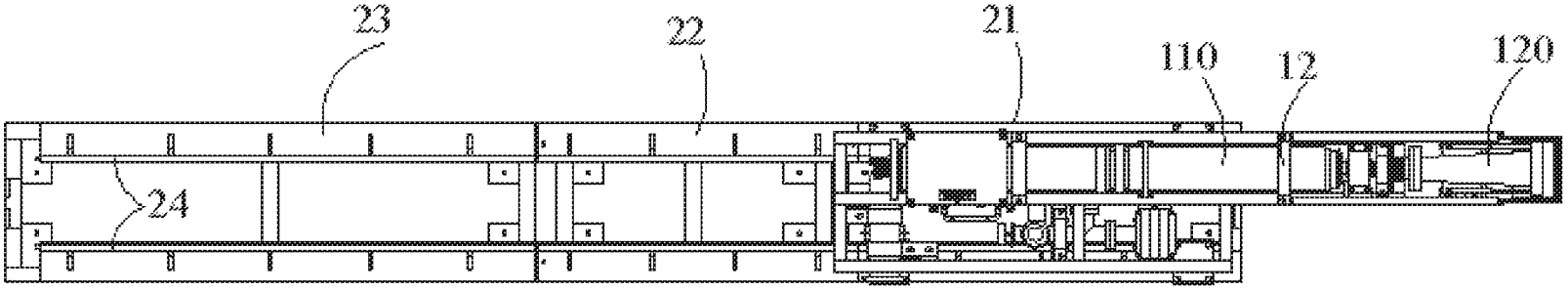
FIG. 3 is a top view of a drawer-type carrying device for an accelerator of the present disclosure.

In this embodiment, as shown in FIGS. 1 and 2, the frame mechanism 10 may include a main frame 11 and at least one fixing and supporting seat 12. The fixing and supporting seat 12 is fixed to an upper side of the main frame 11, and the fixing and supporting seat 12 is used for supporting and fixing the accelerator 100.

In this embodiment, the main frame 11 may include an upper support frame 111, a lower support frame 112, and a pillar 113 connected between the upper support frame 111 and the lower support frame 112. One end of the upper support frame 111 is longitudinally aligned with one end of the lower support frame 112, and the other end of the upper support frame 111 protrudes longitudinally at the other end of the lower support frame 112. The fixing and supporting seat 12 is fixed to the upper support frame 111.

In the present embodiment, the accelerator 100 includes an acceleration tube 110 and a target guard assembly 120. One end of the target guard assembly 120 is connected to one end of the acceleration tube 110. The frame mechanism 10 may further include a protective cover 13 detachably connected to the upper support frame 111 and protruding relative to the other end of the upper support frame 111. The protective cover 13 is capable of covering the other end of the target guard assembly 120.

In this embodiment, the protective cover 13 may include a cover body 131 and a connecting portion 132. The connecting portion 132 is protruded and fixed to the other end of the upper support frame 111, and the cover body 131 is detachably connected with the connecting portion 132. A material outside the cover body 131 may be stainless steel, and a material of an inner liner may be lead.

When the actual ejection is performed, the protective cover 13 is removed and the target guard assembly 120 is exposed. During the maintenance process, the accelerator 100 connects the protective cover 13 to the upper support frame 111 to cover one end of the target guard assembly 120. Particularly, with respect to the accelerator 100 that generates X-rays, the protective cover 13 is provided to provide radiation guard shielding protection at the time of beam ejection, and isolation protection against the activated target after beam stop, thereby preventing maintenance personnel from being radiated.

In this embodiment, the drawing mechanism 20 may include a first rail 21, a second rail 22, and a third rail 23 that are continuously arranged in the longitudinal direction of the frame mechanism 10. At least a pair of rollers 14 are disposed below the frame mechanism 10, and the roller 14 is capable of rolling on the first rail 21, the second rail 22 and the third rail 23 to bring the frame mechanism 10 to move linearly with respect to the drawing mechanism 20 in the longitudinal direction.

The first rail 21 is disposed in the working area A1, the third rail 23 is disposed in the maintenance area A2, a part of the second rail 22 is located in the working area A1, and the other part of the second rail 22 is located in the maintenance area A2.

As shown in FIG. 5, when the accelerator 100 is in the operating state, the frame mechanism 10 is located in the shielding mechanism 40, a side opening door 41 of the shielding mechanism 40 is closed, and the second rail 22 is not installed.

When the accelerator 100 needs to be maintained or adjusted, the side opening door 41 of the shielding mechanism 40 is opened and the second rail 22 is installed, so that the second rail 22 extends across the working area A1 and the maintenance area A2, and continuously arranged with the first rail 21 and the third rail 23 in a straight line to constitute a complete rail-type drawing mechanism 20. The frame mechanism 10 is movable along the first rail 21, the second rail 22, and the third rail 23 to enter the maintenance area A2.

In this embodiment, the corresponding rail may be disassembled or installed according to actual requirements, the installation of the rail is simple and fast, and it is not necessary to greatly modify the existing cabin structure for the accelerator. Therefore, the cabin structure for the accelerator of the embodiment has good operation and high applicability.

It should be understood that the number of rails is not limited thereto, and may be one, two or three or more, and may be adjusted according to actual conditions. Moreover, arrangement of the rails is not limited thereto, and may be in a curved arrangement. The manner of movement of the frame mechanism 10 is not limited to linear motion, and it may also be in a curved motion.

In this embodiment, as shown in FIGS. 5 and 6, the shielding mechanism 40 may include a shielding cavity 42. The first rail 21 is disposed in alignment with the shielding cavity 42. The frame mechanism 10 is capable of entering the working area A1 along the first rail 21, and the target guard assembly 120 enters the shield cavity 42. Therefore, the rail is not only used for the drawing transmission, but also provides an alignment function for the installation of the acceleration tube 110 and the target guard assembly 120, thereby improving the installation efficiency and preventing the target from being damaged due to the misalignment of the target guard assembly 120.

Figure 4:
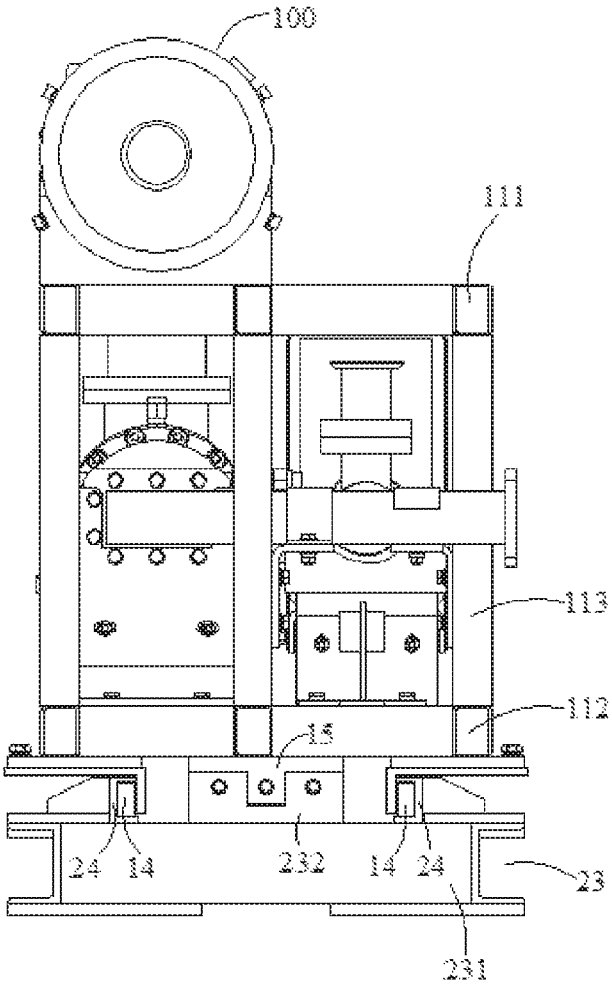
FIG. 4 is a side view of a drawer-type carrying device for an accelerator of the present disclosure.

In this embodiment, as shown in FIGS. 1 and 4, the first rail 21, the second rail 22 and the third rail 23 each include a pair of continuous and aligned guide grooves 24, and a height of the guide groove 24 is the same as a height of the roller 14. A spacing between the pair of guide grooves 24 is equal to a spacing between the pair of rollers 14. The pair of rollers 14 are capable of sliding in the guide groove 24 to bring the frame mechanism 10 to move longitudinally linearly with respect to the drawing mechanism 20, and the guide groove 24 can function to guide and limit the movement of the frame mechanism 10 so as to prevent the frame mechanism 10 from deviating from the rail.

In the present embodiment, as shown in FIGS. 1 and 4, the frame mechanism 10 may further include a fixing portion 15 located at both ends of the main frame 11 and protruding at the lower side of the main frame 11.

The first rail 21 further includes a first seat body 211. The guide groove 24 of the first rail 21 is fixed on the first seat body 211. One end of the first seat body 211 is provided with a first limit portion 212. When the frame mechanism 10 moves to a first position (the right end in FIG. 2), the fixing portion 15 at one end of the main frame 11 is abutted against by the first limit portion 212 and is capable of fixedly connecting with the first limit portion 212.

The third rail 23 further includes a third seat body 231. The guide groove 24 of the third rail 23 is fixed on the third seat body 231. One end of the third seat body 231 away from the first rail 21 is provided with a second limit portion 232. When the frame mechanism 10 moves to the second position (the left end in FIG. 2), the fixing portion 15 at the other end of the main frame 11 is abutted against by the second limit portion 232 and is capable of fixedly connecting with the second limit portion 232.

In this embodiment, fixing portions 15 at both ends of the frame mechanism 10 cooperate with limit portions at both ends of the drawing mechanism 20, and can define a maximum displacement amount of the frame mechanism 10 sliding on the drawing mechanism 20, and, in an extreme position, the fixing portion 15 is fixedly connected with the corresponding limit portion, so that the fastening of the frame mechanism 10 can be achieved to prevent the shaking thereof, and to improve accuracy and safety of the operation.

It should be understood that the form of the drawing mechanism 20 is not limited to the form of a rail, and any solution capable of achieving movement can be applied to the present disclosure, such as a conveyor belt, a hydraulic cylinder, or the like.

Specifically, the drawing mechanism may include a hydraulic cylinder, and a piston rod of the hydraulic cylinder is fixedly connected with the frame mechanism, and the piston rod can bring the frame mechanism to linearly move relative to a cylinder of the hydraulic cylinder during the expansion and contraction of the piston rod.

In summary, compared with the prior art, the present disclosure moves the accelerator in a drawing manner, which greatly reduces the operation difficulty and improving maintenance and adjustment efficiency of the high-power accelerator. Moreover, by utilizing the drawer-type carrying device of the present disclosure, adjustment or maintenance can be accomplished inside the cabin structure for the accelerator. Therefore, it is not necessary to reserve a space volume outside the accelerator cabin, thereby improving utilization of the internal space of the cabin and avoiding waste of the outer space of the cabin.

Although the present disclosure has been described with reference to the exemplary embodiments, it should be understood that the terms are illustrative and exemplary without limitative. The present disclosure may be embodied in a variety of forms without departing from the spirit or scope of the present disclosure. It should be understood that the above-described embodiments are not limited to the foregoing details, and should be interpreted broadly within the spirit and scope of the appended claims. Therefore, all changes and modifications that fall within the scope of the claims or their equivalents should be covered by the appended claims.

What is claimed is:

1. A drawer-type carrying device for an accelerator, comprising:

a frame mechanism for installing the accelerator; and a drawing mechanism connected with the frame mechanism, the frame mechanism being movable relative to the drawing mechanism, wherein the frame mechanism comprises a main frame and at least one fixing and supporting seat, the fixing and supporting seat being fixed to an upper side of the main frame, and the fixing and supporting seat being used for supporting and fixing the accelerator, and wherein the main frame comprises an upper support frame, a lower support frame, and a pillar connected between the upper support frame and the lower support frame, one end of the upper support frame and one end of the lower support frame being aligned in a longitudinal direction, while the other end of the upper support frame protruding relative to the other end of the lower support frame in the longitudinal direction, and the fixing and supporting seat being fixed to the upper support frame.

2. The drawer-type carrying device according to claim 1, wherein the frame mechanism further comprises a protective cover detachably connected to the upper support frame and protruding at the other end of the upper support frame.

3. The drawer-type carrying device according to claim 2, wherein the protective cover comprises a cover body and a connecting portion, the connecting portion being protruded and fixed to the other end of the upper support frame, and the cover body being detachably connected to the connecting portion.

4. The drawer-type carrying device according to claim 3, wherein a material outside the cover body is stainless steel and a material of an inner liner is lead.

5. The drawer-type carrying device according to claim 1, wherein the drawing mechanism comprises a first rail, a second rail, and a third rail that are continuously arranged in a longitudinal direction of the frame mechanism, at least a pair of rollers being disposed under the frame mechanism, and the roller being configured to roll on the first rail, the second rail and the third rail to bring the frame mechanism to move longitudinally relative to the drawing mechanism.

6. The drawer-type carrying device according to claim 5, wherein the first rail, the second rail, and the third rail each include a pair of continuous and aligned guide grooves, a height of the guide groove being the same as a height of the roller, a spacing between the pair of guide grooves being equal to a spacing between the pair of rollers, and the pair of rollers being configured to slide within the guide groove to bring the frame mechanism to move linearly longitudinally relative to the drawing mechanism.

7. The drawer-type carrying device according to claim 5, wherein the frame mechanism further comprises a fixing portion located at both ends of the main frame and protruding at a lower side of the main frame; the first rail further comprises a first seat body, the guide groove of the first rail being fixed on the first seat body, and one end of the first seat body being provided with a first limit portion, the fixing portion at one end of the main frame being abutted against by the first limit portion and being capable of fixedly connecting with the first limit portion when the frame mechanism moves to a first position; the third rail further comprises a third seat body, the guide groove of the third rail being fixed on the third seat body, and an end of the third seat body away from the first rail being provided with a second limit portion, the fixing portion at the other end of the main frame being abutted against by the second limit portion and being capable of fixedly connecting to the second limit portion when the frame mechanism moves to a second position.

8. The drawer-type carrying device according to claim 1, wherein the drawing mechanism comprises a hydraulic cylinder, a piston rod of the hydraulic cylinder being fixedly connected to the frame mechanism, and the piston rod being configured to bring linearly the frame mechanism relative to the cylinder of the hydraulic cylinder during expansion and contraction process of the piston rod.

9. A cabin structure for an accelerator comprising a cabin, a shielding mechanism, and a drawer-type carrying device for an accelerator, the drawer-type carrying device for an accelerator comprising:

a frame mechanism for installing the accelerator; and a drawing mechanism connected with the frame mechanism, the frame mechanism being movable relative to the drawing mechanism;

the cabin having a working area and a maintenance area, and a shielding mechanism being disposed in the working area, the shielding mechanism having a door facing towards the maintenance area, and the frame mechanism being configured to be drawn from the shielding mechanism into the maintenance area when the door is opened.

10. The cabin structure for the accelerator according to claim 9, wherein the accelerator comprises an acceleration tube and a target guard assembly, one end of the target guard assembly being connected to one end of the acceleration tube.

11. The cabin structure for the accelerator according to claim 9, wherein the frame mechanism comprises a main frame and at least one fixing and supporting seat, the fixing and supporting seat being fixed to an upper side of the main frame, the fixing and supporting seat being used for supporting and fixing the accelerator; the frame mechanism also comprises a protective cover that is detachably connected to an upper support frame of the main frame and that is capable of covering the other end of the target guard assembly.

12. The cabin structure for the accelerator according to claim 9, wherein the drawing mechanism comprises a first rail, a second rail and a third rail continuously arranged in a longitudinal direction of the frame mechanism, the first rail being disposed in the working area, the third rail being disposed in the maintenance area, a part of the second rail being located in the working area, and the other part of the second rail being located in the maintenance area, and at least one pair of rollers being disposed under the frame mechanism, and the roller being capable of rolling on the first rail, the second rail and the third rail.

13. The cabin structure for the accelerator according to claim 12, wherein the shielding mechanism comprises a shielding cavity, the first rail being aligned with the shielding cavity, the frame mechanism being capable of entering the working area along the first rail, and the target guard assembly being capable of entering the shielding cavity.

* * * * *